US006449845B1

(12) United States Patent
Specht et al.

(10) Patent No.: US 6,449,845 B1
(45) Date of Patent: Sep. 17, 2002

(54) METHOD OF MANUFACTURING A GEAR PART

(75) Inventors: Gerold Specht, Harsewinkel; Silke Steinke, Hamm, both of (DE)

(73) Assignee: Leico GmbH & Co. Werkzeugmaschinenenbau, Ahlen (DE)

( * ) Notice: Subject to any disclaimer, the term of this patent is extended or adjusted under 35 U.S.C. 154(b) by 0 days.

(21) Appl. No.: 09/526,515

(22) Filed: Mar. 16, 2000

(30) Foreign Application Priority Data

Mar. 22, 1999 (DE) ..... 199 12 841

(51) Int. Cl.[7] ..... B23P 17/00

(52) U.S. Cl. ..... 29/892.2; 74/434; 74/443; 29/892.3; 29/893.3

(58) Field of Search ..... 29/892.2, 892.3, 29/893.3, 893.32, 893.33, 893.34, 893.35; 474/166, 180–183, 187, 94; 74/434, 443; D8/360

(56) References Cited

U.S. PATENT DOCUMENTS 6,283,686 B1 * 9/2001 Gill ..... 409/26

FOREIGN PATENT DOCUMENTS

| | | |
|---|---|---|
| DE | 37 11 927 | 10/1988 |
| DE | 195 11 963 A1 | 3/1995 |
| DE | 196 01 020 | 7/1997 |
| DE | 197 01 565 | 8/1997 |
| DE | 136 818 | 1/2002 |

OTHER PUBLICATIONS

V. Getriebe, Niemann, Machinenelemente, Springer–Verlag, Machinenelemente–Entwerfen, Berechnen und Gestalten im Machinebau, vol. II, No. 2, XP–002140996, pp. 1–20, "Verwendung, Vergleiche und Grundgleichungen", 1961.

* cited by examiner

*Primary Examiner*—P. W. Echols
(74) *Attorney, Agent, or Firm*—Oblon, Spivak, McClelland, Maier & Neustadt, P.C.

(57) ABSTRACT

The invention relates to a method for the manufacture of a gear part with a transversely directed profile, particularly a timing belt pulley, wherein a substantially rotationally symmetrical workpiece is fixed in a flow-forming device and rotated and wherein at least one profiled flow-forming tool is infed to a circumferential area of the workpiece such that a transversely directed profile is formed. According to the invention, prior to the forming of the transversely directed profile, the circumferential area of the workpiece is provided with at least one circumferentially directed groove and the transversely directed profile is formed axially on either side of the at least one groove. The invention also relates to a gear part, particularly a timing belt pulley, which has a substantially rotationally symmetrical construction and a circumferential area and which is provided with a transversely directed profile. According to the invention, the circumferential area has at least one substantially circumferentially directed groove, the transversely directed profile being positioned axially on either side of the groove.

12 Claims, 2 Drawing Sheets

METHOD OF MANUFACTURING A GEAR PART

BACKGROUND OF THE INVENTION

1. Field of the Invention

The invention relates to a method for the manufacture of a gear part with a transversely directed profile, particularly a timing belt pulley, in which a substantially rotationally symmetrical workpiece is fixed in a flow-forming device and rotated and at least one profiled flow-forming tool is infed to a circumferential area of the workpiece and the transversely directed profile is shaped. The invention also relates to a gear part, particularly a timing belt pulley, which has a substantially rotationally symmetrical construction, a circumferential area and which is provided with a transversely directed profile.

2. Discussion of the Background

Methods and gear parts are e.g. known from DE 37 11 927 or DE 196 01 020. Thus, for example, toothed gears or timing belt pulleys are provided with transversely directed teeth forming a straight or helical tooth system in a circumferential area of a workpiece using a flow-forming machine through the radial infeeding of a profiled flow-forming roller. Such gear parts can be used in the most varied gears, which are inter alia employed in motor vehicle construction. Particularly in the latter field there is an ever greater need for gears, which are improved from the noise development standpoint.

SUMMARY OF THE INVENTION

The object of the invention is to provide a gear part with a good and in particular low-noise operating behavior and a method which is particularly suitable for the manufacture of the gear part.

The invention builds upon the aforementioned method in that prior to the shaping of the transversely directed profile the circumferential area of the workpiece is provided with at least one circumferentially directed groove and that the transversely directed profile is shaped axially on either side of the at least one groove.

A fundamental idea of the method according to the invention is consequently to provide the circumferential area of the workpiece with at least one circumferentially directed groove prior to the shaping of the transversely directed profile. Thus, in a simple manner it is possible to produce a transversely directed profile by flow-forming, because the circumferential groove permits an improved axial material flow. Following forming, the groove can be filled in an almost unchanged or complete manner.

According to a preferred further development of the method, the groove is constructed with a predetermined width in the outer circumferential area and the groove width is reduced during the forming of the transversely directed profile. Thus, in addition to the transversely directed profile, a particularly dimensionally stable, narrow groove can be produced.

The method according to the invention is in particular simplified in that during the forming of the profile material of the workpiece is displaced transversely in the direction of the groove.

As a function of the method steps utilized, different groove shapes can be produced. Thus, in a radially outer area the groove can be closed again, so that a circumferential channel is formed in the profile.

However, according to a preferred development of the method, the substantially rotationally symmetrical workpiece is produced by casting or forging. This makes it possible to utilize in each case specific advantages of cast and forged preforms, such as, for example, material characteristics or a special shaping. It is particularly advantageous if the at least one circumferentially directed groove is formed during casting or forging. An additional method step of introducing the groove in the workpiece can consequently be obviated.

Alternatively, the at least one circumferentially directed groove is introduced by radial infeeding of a forming roller in the circumferential area of the workpiece. This makes it possible to perform the method steps of introducing both the groove and the transversely directed profile on a flow-forming device. This permits a particularly rapid and therefore inexpensive manufacture of the gear parts according to the invention. In addition, on rolling in the groove, a notch effect in the material is counteracted. The groove depth preferably corresponds to the profile or tooth height or can be somewhat smaller or larger.

Fundamentally the groove could also be made in the workpiece in a metal-removing manner, such as by turning.

According to a further development of the method of the invention, it is advantageous that the substantially rotationally symmetrical workpiece is shaped from a circular blank in the flow-forming device. This also leads to the advantage that a further method step, namely the production of the rotationally symmetrical workpiece as a preform, can be carried out on the same flow-forming device. Thus, a complete machining of the gear part according to the invention can take place in a single setting.

A particularly simple manufacture of the circumferential area of the substantially rotationally symmetrical workpiece can take place by upsetting, splitting or wrapping round an edge of the workpiece (i.e. sloping the circumferential edge of the workpiece so that a rim is formed on the workpiece).

According to another preferred embodiment of the method, the at least one circumferentially directed groove is constructed as a circular channel. The substantially semicircular cross-section of the groove constructed as a circular channel reduces the appearance of stress peaks, so that a particularly material-protecting manufacture can take place.

Preferably the profile is formed in the circumferential area of the workpiece by means of a flow-forming roller or by means of a cross-rolling ledge or strip. Both possibilities permit a precise, rapid machining of the workpiece and are consequently particularly advantageous for an inexpensive manufacture of gear parts according to the invention.

In a further development of the method, a double helical tooth system is formed as the transversely directed profile and comprises two tooth system areas, which are arranged under a sweepback angle to one another. Thus, in the circumferential area of the workpiece it is possible to produce a double helical tooth system with a central groove and simultaneously a high quality of the double helical tooth system is maintained.

Preferably the two tooth system areas of the double helical tooth system are adjacent one another in a connecting area, which runs along the groove. Thus, in the case of high quality manufacturing both the tooth system and the intersection of the two tooth system areas can be produced in the sweepback angle.

The invention improves upon the aforementioned gear part in that the circumferential area has at least one substantially circumferentially directed groove and the transversely directed profile is arranged axially on either side of the groove. As a result of the at least one circumferential groove provided in addition to the transversely directed profile, it is possible to reduce vibrations occurring during the operation of the gear part, which ensures a good and particularly low-noise operating behavior.

This is based on the inventive determination that vibrations and noise during the operation of the gear part are inter alia caused by the compression of a surrounding medium, particularly air, between two meshing teeth. The additional groove, on either side of which is located the transversely directed profile, permits a better pressure compensation at the tooth and good air removal from the meshing tooth areas. This counteracts the formation of strong pressure pulsations and, as a result, the operating behavior is improved and the occurrence of vibrations and noise are reduced.

According to a preferred embodiment of the invention, the groove has a width which, in a radially outer circumferential area, is smaller than in a radially inner circumferential area. This has the advantage that the profile, on the one hand, has a particularly high mechanical stability and, on the other hand, the groove adequately strongly contributes to the reduction of vibration and noise, e.g. by absorbing and removing enclosed air. As a function of the axial extension of the transversely directed profile, it is also possible to form several circumferential grooves, which permits even better vibration reduction.

Fundamentally, as the transversely directed profile, use can be made of the most varied tooth shapes, which run in an inclined or right angle transversely to the circumferential direction. However, according to a particularly preferred embodiment of the invention, the transversely directed profile is constructed as a double helical tooth system. As a result of the teeth arranged in swept-back manner, flying off of the timing or toothed belt during operation is prevented, so that additional timing belt-guiding flanges on the two end faces of the toothed belt pulley are unnecessary. There is also a compensation of axial forces with this shape.

It is also preferable for the circumferential area to have a cylindrical construction, wherein in the central area a boss is provided and wherein the boss is connected to the circumferential area by means of a circular blank web. Such one-piece gear parts can be particularly inexpensively manufactured as a result of their material-saving, lightweight construction and can contribute to reducing the weight of machine or vehicle gears.

Finally, a preferred embodiment of the invention is characterized in that the circular blank web has an area, which is conical to the rotation axis. This makes it possible to choose the position of the tooth system of the inventive gear parts with respect to a driving shaft or a rotational axis as a function of specific requirements and to achieve a particularly rigid gear part.

BRIEF DESCRIPTION OF THE DRAWINGS

The invention is described in greater detail hereinafter relative to preferred embodiments and with reference to the attached drawings, wherein are shown.

DESCRIPTION OF THE PREFERRED EMBODIMENTS

Figure 1D:
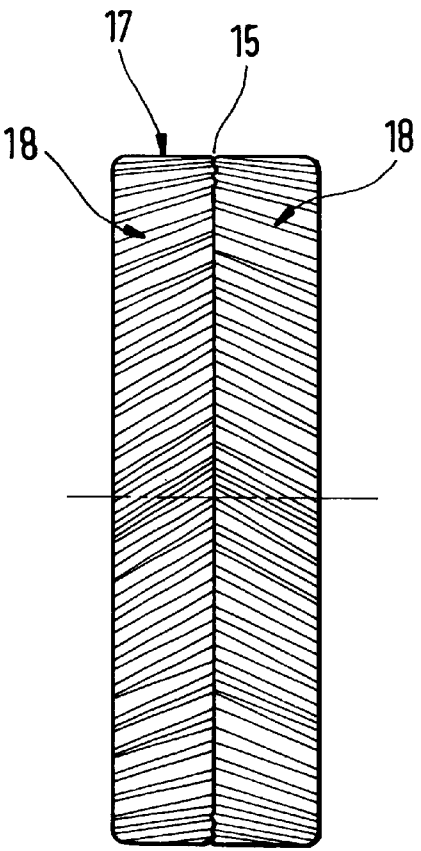
FIGS. 1*a*-1*c* are sectional views which illustrate a rotationally symmetrical workpiece before and after individual steps of the method according to the invention, FIG. 1(*d*) shows a diagrammatic side view of a toothed belt pulley according to the invention.
Figure 1C:
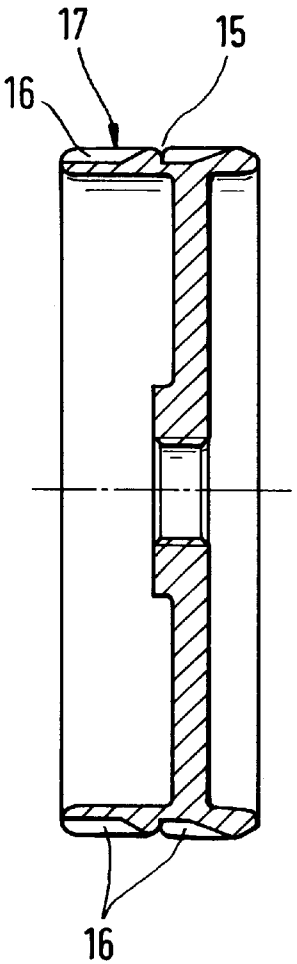
Figure 1B:
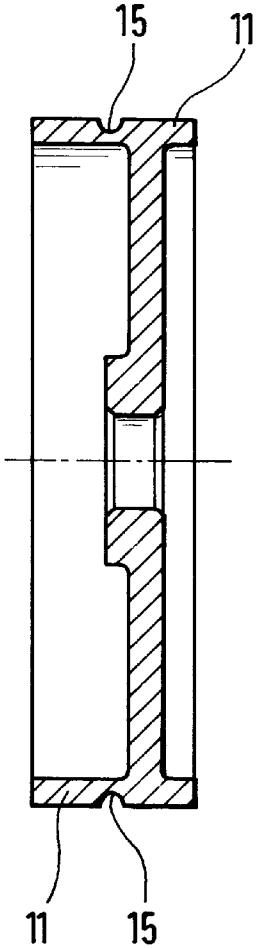
Figure 1A:
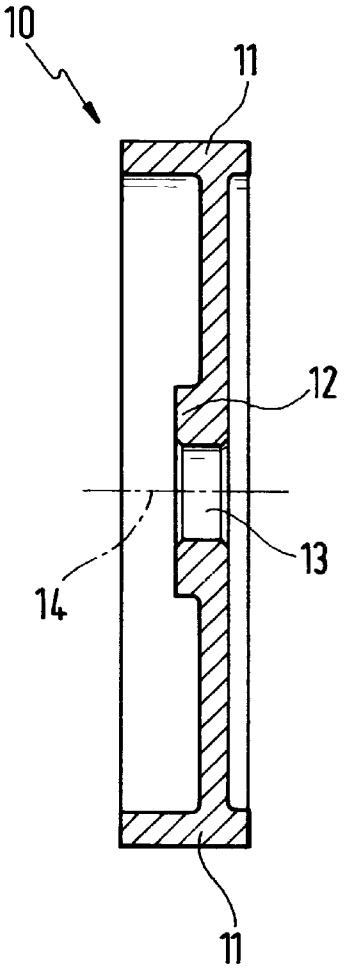

FIG. 1*a* is a sectional view of a rotationally symmetrical workpiece 10 with a cylindrically constructed circumferential area 11, as well as a boss 12 with a central hole 13. The workpiece 10 symmetrical to a rotational axis 14 can be manufactured in different ways, particularly by flow-forming, casting or forging.

FIG. 1*b* shows the workpiece 10 after introducing a circumferentially directed groove 15 in the circumferential area 11. As can be understood, in this embodiment the groove is constructed in the form of a circular channel, i.e. it has a roughly semicircular cross-section. The groove 15 is preferably made in a flow-forming machine by the radial infeeding of a forming roller. However, alternatively the groove 15 can be produced during the casting or forging of the workpiece 10.

FIG. 1*c* shows a sectional view of the workpiece according to the invention after introducing a transversely directed profile 17 in the circumferential area 11 provided with the groove 15. The circumferential area 11 in this view has transversely directed tooth depressions 16. In the preferred embodiment shown here the width of the groove 15 during the forming of the profile 17 has been reduced compared with its original width, as shown in FIG. 1*b*. However, a narrow gap remains as a passage to the opposite tooth profile.

In the diagrammatic side view of the inventive workpiece in FIG. 1*d* the groove 15 and the two tooth system areas 18 of the transversely directed profile 17, which is constructed as a double helical tooth system, are shown. As can be understood, the two tooth system areas 18 of the double helical tooth system are adjacent one another in the vicinity of the groove.

Figures 2A, 2B, 2C, 2D, 2E, 2F:
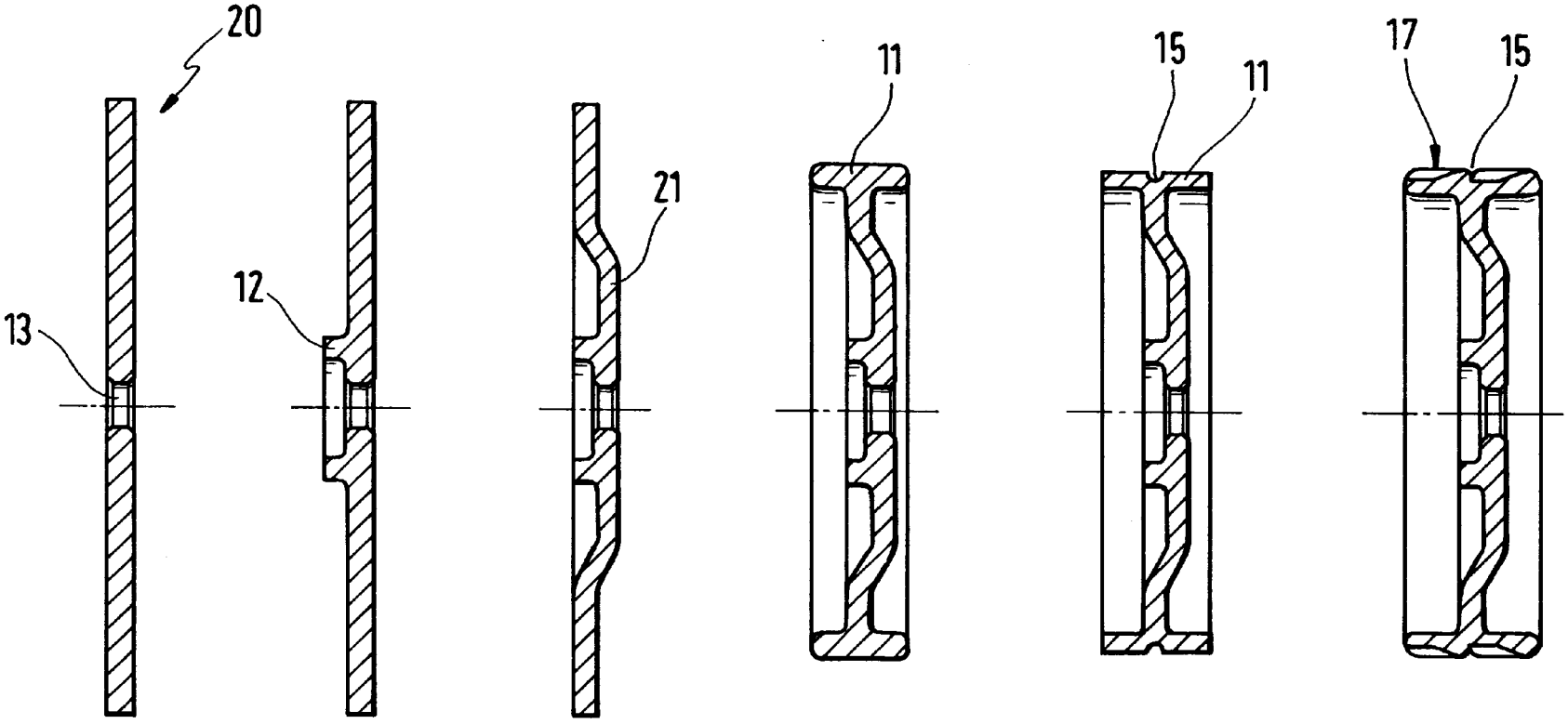
FIGS. 2*a*-2*f* are sectional views of a rotationally symmetrical workpiece before and after individual steps of a preferred further development of the method according to the invention.

FIG. 2*a* is a sectional view of a circular blank 20 provided with a central hole 13 and from which is formed in stepwise manner by flow-forming a rotationally symmetrical workpiece, wherein forming takes place of a boss 12 (FIG. 2*b*), a conical circular blank web 21 (FIG. 2*c*) and a circumferential area 11 (FIG. 2*d*). The circumferential area 11 is produced by upsetting or splitting. According to the invention, in the circumferential area of the thus produced, rotationally symmetrical workpiece is then formed a groove 15 (FIG. 2*e*) and subsequently a transversely directed profile 17 (FIG. 2*f*). There can also occur a special axial lengthening of the circumferential area.

Obviously, numerous modifications and variations of the present invention are possible in light of the above teachings. It is therefore to be understood that within the scope of the appended claims, the invention may be practiced otherwise than as specifically described herein.

What is claimed is:

1. Method for the manufacture of a gear part with a transversely directed profile, which comprises:

fixing a substantially rotationally symmetrical workpiece in a flow-forming device;

rotating the workpiece;

infeeding at least one profiled flow-forming tool to a circumferential area of the workpiece and forming the transversely directed profile;

providing, prior to the forming of the transversely directed profile, the circumferential area of the workpiece with at least one circumferentially directed groove in the workpiece; and axially forming the transversely directed profile on both sides of the at least one groove.

2. Method according to claim 1, which comprises forming the groove with a predetermined width in the outer circumferential area and, upon forming the transversely directed profile, reducing the groove width.

3. Method according to claim 1, which comprises, upon forming the profile workpiece, displacing a material of the workpiece transversely in the direction of the groove.

4. Method according to claim 1, which comprises introducing the at least one circumferentially directed groove by radial infeeding of a forming roller in a circumferential area of the workpiece.

5. Method according to claim 1, which comprises forming the substantially rotationally symmetrical workpiece in the flow-forming device from a circular blank.

6. Method according to claim 5, which comprises producing the circumferential area by one of an upsetting step, a splitting step and a step of wrapping round an edge of the workpiece.

7. Method according to claim 1, which comprises producing the substantially rotationally symmetrical workpiece by one of a forging step and a casting step.

8. Method according to claim 1, which comprises forming the at least one circumferentially directed groove during one of a forging step and a casting step.

9. Method according to claim 1, which comprises constructing the at least one circumferentially directed groove as a semi-circular channel.

10. Method according to claim 1, which comprises forming the profile in the circumferential area of the workpiece by using one of a flow-forming roller and a cross-rolling ledge.

11. Method according to claim 1, which comprises forming the transversely directed profile as a double helical tooth system, comprising two tooth system areas, which have a sweepback angle with respect to one another.

12. Method according to claim 11, which comprises positioning the two tooth system areas of the double helical tooth system are adjacent one another in a connecting area located along the groove.

* * * * *

UNITED STATES PATENT AND TRADEMARK OFFICE

CERTIFICATE OF CORRECTION

PATENT NO. : 6,449,845 B1
DATED : September 17, 2002
INVENTOR(S) : Specht et al.

It is certified that error appears in the above-identified patent and that said Letters Patent is hereby corrected as shown below:

Title page,
Item [73], Assignee should read:

-- [73] Assignee: Leico GmbH & Co.
Werkzeugmaschinenbau, Ahlen (DE) --

Signed and Sealed this

Twenty-eighth Day of January, 2003

JAMES E. ROGAN
*Director of the United States Patent and Trademark Office*